United States Patent [19]

Hamada et al.

[11] Patent Number: 5,050,917

[45] Date of Patent: Sep. 24, 1991

[54] STRIKER FOR VEHICLE DOOR LOCK

[75] Inventors: Yoshikazu Hamada, Utsumoniya; Makoto Abekura, Nirasaki, both of Japan

[73] Assignee: Mitsui Kinzoku Kogyo Kabushiki Kaisha, Tokyo, Japan

[21] Appl. No.: 588,217

[22] Filed: Sep. 26, 1990

[30] Foreign Application Priority Data

Sep. 28, 1989 [JP] Japan ..... 1-253288

[51] Int. Cl.[5] ..... E05C 3/24

[52] U.S. Cl. ..... 292/340; 292/216; 292/DIG. 40

[58] Field of Search ..... 292/340, 341.12, 341.13, 292/216, DIG. 39, DIG. 40

[56] References Cited

U.S. PATENT DOCUMENTS

| | | | |
|---|---|---|---|
| 2,499,165 | 2/1950 | Roethel | 292/341.12 |
| 3,705,738 | 12/1972 | Yoshimura | 292/341.12 X |
| 4,466,645 | 8/1984 | Kobayashi | 292/341.12 |
| 4,756,563 | 7/1988 | Garwood et al. | 292/337 X |
| 4,941,696 | 7/1990 | Yamada et al. | 292/340 |

*Primary Examiner*—Richard E. Moore

*Attorney, Agent, or Firm*—Browdy and Neimark

[57] ABSTRACT

A striker used in a lock device of a vehicle door has a U-shaped rod provided with an outside leg, an inside leg extending in parallel with the outside leg, and a connecting portion joining the ends of both legs. In order to strengthen the striker, the sectional area of the inside leg is larger than the outside leg, and the connecting portion has a wedge shape the thick portion thereof being placed at the inside portion. Thus, strength of the connecting portion to the inside leg is made larger than that of another connecting portion to the outside leg.

5 Claims, 2 Drawing Sheets

STRIKER FOR VEHICLE DOOR LOCK

BACKGROUND OF THE INVENTION

The present invention relates to a striker fixed to a construction of a vehicle and engaged with a door lock device secured to a door of the vehicle.

PRIOR ART

Nowadays, strikers for vehicle door locks of various shapes have been proposed. FIG. 6 shows a most widely used striker which is constructed by a vertical base plate A, two legs C and D projecting sideways from the base plate A, and a U-shaped rod B having a connection bar E joining ends of the legs C and D.

It is necessary to such strikers to have a strength holding surely the door even when a heavy shock is applied to the body construction of the vehicle. The U-shaped rod B has a shape of U formed by bending a straight rod. When the predetermined diameter of the rod is not sufficient to satisfy the safety or strength standards, it is necessary to thicken the rod.

However, when the rod B is directly thicken, a whole size of the door lock will become large, resulting disadvantageously in considerable increase of a cost of the door lock.

SUMMARY OF THE INVENTION

The present invention is invented after experiences and studies on strength of the strikers.

According to experiences on strength of the strikers, applying a strong force P as shown FIG. 2 in a door-opening direction pulls an outside leg C through a latch F of the lock device, resulting in distortion or deformation of the rod B as shown in FIG. 6. When the distortion is large, the latch F is apt to be disengaged from the outside leg C. In the most bad situation, the rod B will be twisted off. The primary reason for such deformation is occurence of cracks I and J, respectively at an outside part of an outside connection portion G and an inside part of an inside connection portion H.

It has been found that, when only the inside connection portion H is reinforced, distortion of the rod B is considerably restricted or controlled without any reinforcement of the outside leg C and the outside connection portion G.

Consequently, it is the purpose of the present invention to provide a more rigid striker without thickening the outside leg and the outside connection portion, which thickening has a bad effect to the size of the door lock device.

EMBODIMENTS

Figure 1:
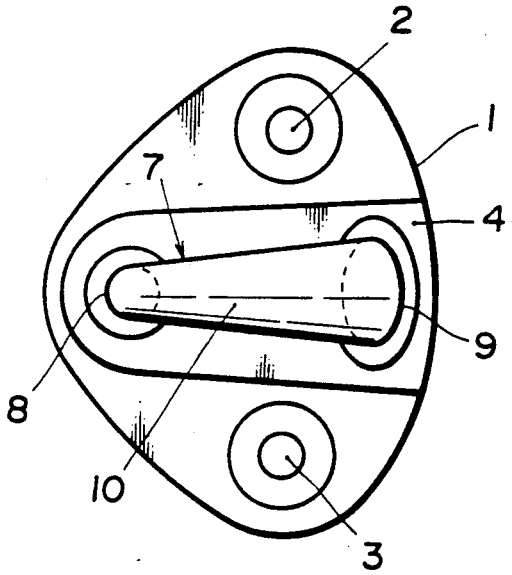
FIG. 1 is a front view of the striker according to the present invention.
Figure 2:
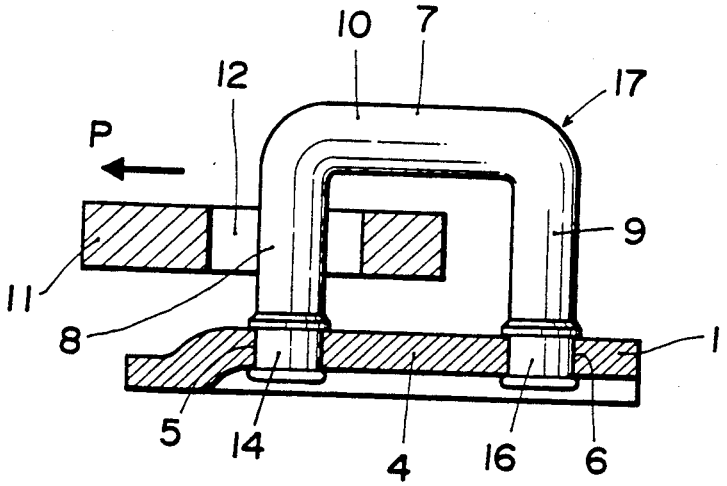
FIG. 2 is a cross-section of the striker.
Figure 3:
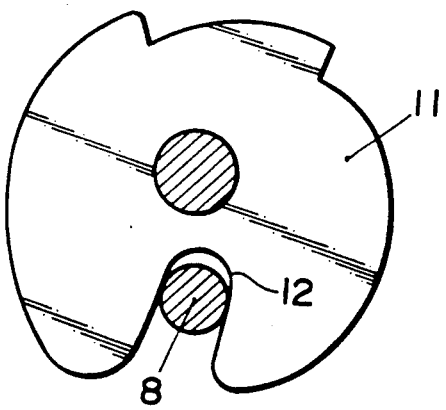
FIG. 3 is an engagement relation between the lock device and the striker.
Figure 4:
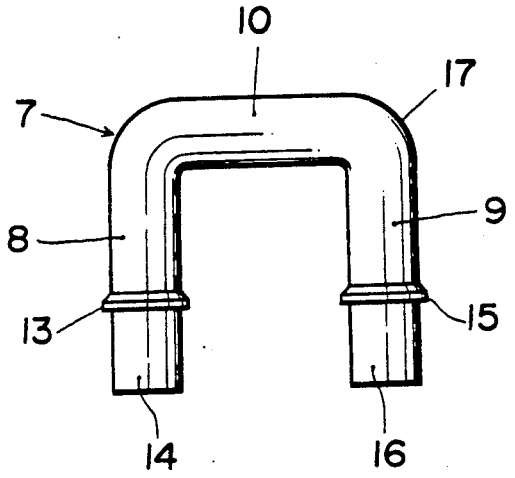
FIG. 4 shows a flat view of the U-shaped rod.

One embodiment of the striker of the lock device according to the present invention will be explained with reference to the accompanying drawing. Apparently, the striker S of the lock device consists of a base plate 1 and a U-shaped rod 7. The base plate 1 is formed by punching an iron or steel plate and the like. The shape of the base plate 1 is symmetrical with respect to a vertical line. The base plate 1 has an expanded or convex portion 4 at its vertical-middle portion. Through holes 2 and 3 are formed at an upper position and a lower position of the convex portion 4. Screws are inserted through the holes 2 and 3 so as to fix the lock device to columns of the vehicle. The convex portion 4 has a pair of securing holes 5 and 6.

Figure 5B:
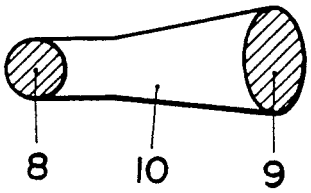
FIG. 5 is a longitudinal-section of the U-shaped rod.
Figure 5A:
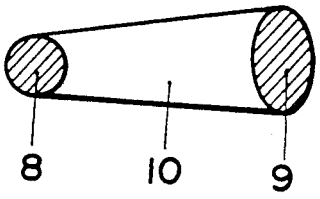
Figure 6:
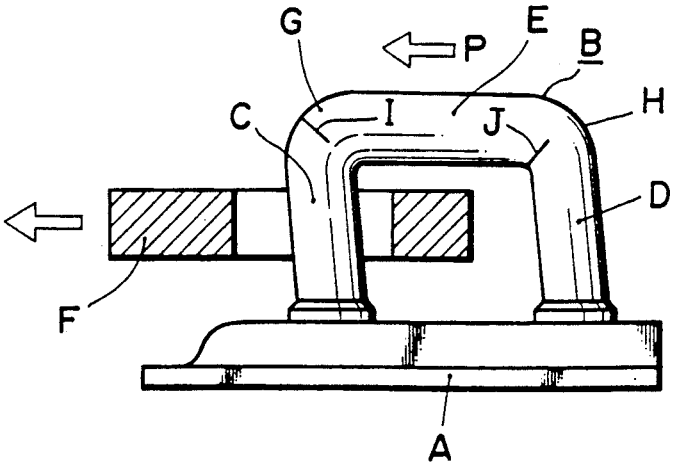
FIG. 6 depicts a lock device of the prior art.

The U-shaped rod 7 is manufactured by forging and has the outside leg 8 to be engaged with the latch 11 of the door lock device, the inside leg 9 extending in parallel to the outside leg 8, and the connecting portion 10 joining mutually both ends of the outside leg 8 and the inside leg 9. Apparently, the outside leg 8 has a shape of round column of a diameter determined so as to make the leg neatly fit to an engagement groove 12 of the latch 11. The inside leg 9 is formed to have a shape of right round column or elliptic section column (FIG. 5) thicker than the outside leg 8.

The connecting portion 10 joining the outside leg 8 and the inside leg 9 has a shape of wedge increasing in its sectional area toward the inside leg 9. As a result, it is possible to considerably raise the strength of an inside connecting portion 17 between the inside leg 9 and the connecting portion 10 without increasing the outside leg 8 and an outside connecting portion 18 joining the outside portion 8 and the connecting portion 10, resulting in limitting deformation of the U-shaped rod 7 to minimum even though an excessive shock is given to the door.

Ends 14 and 16 of these legs 8 and 9 are inserted into the securing holes 5 and 6 and caulked. Reference numerals 13 and 15 are flanges formed on the legs 8 and 9 of the striker.

What is claimed is:

1. A striker for a vehicle door lock device, which comprises a metal base plate secured to the construction of the vehicle and a metal-made U-shaped rod consisting of an outside leg fixed to the base plate so as to engage with a latch of the door lock device secured to the door, an inside leg in parallel with said outside leg, and a connecting portion joining ends of the outside leg and the inside leg, wherein said inner leg has a sectional area larger than that of said outside leg and said connecting portion has a shape of wedge increasing at its sectional area toward the inside leg from the outside leg, so that the strength of a joining portion between the inside leg and the connecting portion is larger than that of the joining portion of the outside leg to said connecting portion.

2. An apparatus in accordance with claim 1 wherein said inner and outer legs and said connecting portion is constructed entirely of a metallic material.

3. An apparatus in accordance with claim 1, wherein the cross-section of said striker gradually changes from said outer leg to said inner leg.

4. An apparatus in accordance with claim 3, wherein said center section gradually changes from a circular cross-section to an elliptic cross section.

5. A striker for a vehicle door lock device, which comprises a metal base plate secured to the vehicle and a metal-made U-shaped rod consisting of an outside leg fixed to the base plate so as to engage with a latch of the door lock device secured to the door, an inside leg in parallel with said outside leg, and a connecting portion joining ends of the outside leg and the inside leg, wherein said inner leg has an elliptical cross-section and said outside leg has a circular cross-section and said connecting portion has a shape of wedge increasing at its sectional area toward the inside leg from the outside leg, so that the strength of a joining portion between the inside leg and the connecting portion is larger than that of the joining portion of the outside leg to said connecting portion.

* * * * *